United States Patent [19]

Levine

[11] 4,317,247

[45] Mar. 2, 1982

[54] DRIVE ATTACHMENT FOR A DRAIN CLEANING PLUMBING TOOL

[76] Inventor: Aaron J. Levine, 3147 N. Cambridge Ave., Chicago, Ill. 60657

[21] Appl. No.: 126,552

[22] Filed: Mar. 3, 1980

[51] Int. Cl.[3] ..... B08B 9/02

[52] U.S. Cl. ..... 15/104.3 SN

[58] Field of Search ..... 15/104.3 SN, 104.3 R

[56] References Cited

U.S. PATENT DOCUMENTS

| | | | |
|---|---|---|---|
| 2,279,769 | 4/1942 | Von Bon Horst | 15/104.3 SN X |
| 2,284,939 | 6/1942 | Asnard | 15/104.3 SN |
| 2,470,225 | 5/1949 | Silverman | 15/104.3 SN |
| 3,268,937 | 8/1966 | Bollinger | 15/104.3 SN |
| 3,609,788 | 10/1971 | Mier | 15/104.3 SN |
| 3,727,261 | 4/1973 | Levine | 15/104.3 SN |

OTHER PUBLICATIONS

Illinois Faucet Co. Publication, 1976, "Blockage Buster".

*Primary Examiner*—Edward L. Roberts

*Attorney, Agent, or Firm*—Hill, Van Santen, Steadman, Chiara & Simpson

[57] ABSTRACT

An attachment for a manually operable drain, pipe and trap cleaning tool permits connection of the tool to an electric drill for motorized operation of the tool. The drain cleaning tool has a stationary housing portion having a pistol-grip handle from which an enlarged end of a flexible plumber's rod extends, and a rotatable portion containing the coiled remainder of the rod. The rotatable portion has a central circular opening therein which receives a correspondingly shaped disc portion of the drive attachment. The disc is rigidly affixed to the rotatable housing portion by screws. An arbor receivable in a drill chuck is rigidly affixed perpendicularly to the disc at its center. The chuck is tightened about the arbor so that operation of the drill rotates the rotatable housing portion as well as the plumber's rod contained therein, with the rotational movement being transmitted along the length of the rod to the end thereof which is inserted into a drain to be cleaned.

5 Claims, 3 Drawing Figures

DRIVE ATTACHMENT FOR A DRAIN CLEANING PLUMBING TOOL

BACKGROUND OF THE INVENTION

1. Field of the Invention

The present invention relates to attachments for rotatable drain cleaning tools, and in particular to an attachment facilitating motorized operation of a drain cleaning tool.

2. Description of the Prior Art

Drain cleaning tools are known which utilize a motor driven rotating plumber's rod which is inserted in a clogged drain, pipe or trap to disburse debris therein. Such a device is disclosed and claimed in U.S. Pat. No. 3,727,261 issued on Apr. 17, 1973 to the inventor herein.

Although motorized devices of the above-described type have wide application, particularly by professional users, a domestic user who may only have occasional need for such a device may not wish to make the expenditure for a device which includes a motor drive as part of the unit. For such domestic users, a manually operable drain cleaning tool is known which is marketed under the trademark "BLOCKAGE BUSTER", U.S. Registration No. 1,005,228. This manual device has a housing consisting of a handle portion and a manually rotatable portion which contains a coiled plumber's rod. The end of the rod extends out of the handle portion. A length of rod sufficient to reach to the clogged portion of a drain to be cleaned is pulled from the tool and locked into place by a thumb screw. The rotatable portion of the housing is then manually rotated by gripping a molded handle thereon which in turn rotates the rod in the drain.

While the manually operable version provides an inexpensive drain cleaning tool, the continuous rotation necessary to unclog many drains can be tiring, thus diminishing the effectiveness of the cleaning operation, or preventing use of the manual device altogether.

SUMMARY OF THE INVENTION

It is an object of the present invention to provide an attachment for a normally manually operable drain cleaning tool which permits operation of the device by an electric drill.

In accordance with the principles of the present invention, an attachment for a manually operable drain cleaning tool has a disc portion receivable in a correspondingly shaped opening in the rotatable portion of the drain cleaning tool which is held therein by screws and washers and which has a rod perpendicularly attached at its center. The rod is receivable in the chuck of an ordinary electric drill. When the drill is operated, the attachment and the housing containing the coiled rod are corotated, which in turn rotates the end of the rod in the drain. The manually operable drain cleaning tool and the drive attachment therefor can be purchased separately at a relatively low cost, without the necessity of purchasing a motorized device. The manual device and the attachment can then be utilized with an ordinary household electric drill which can be used in many other applications, thereby minimizing cost to the user.

DESCRIPTION OF THE PREFERRED EMBODIMENTS

Figure 1:
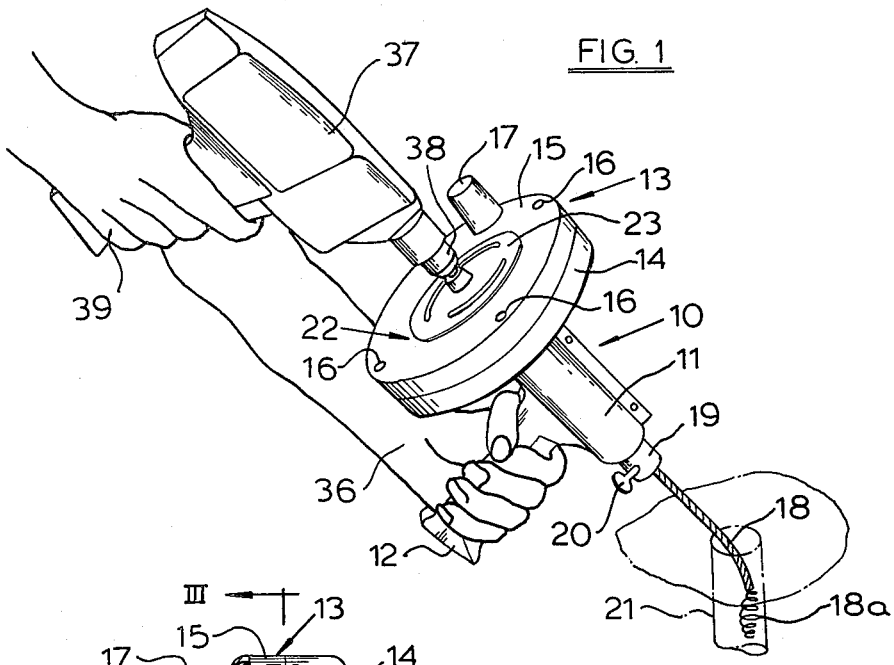
FIG. 1 is a perspective view of a drain cleaning tool with the attachment disclosed herein in use with an electric drill.
Figure 2:
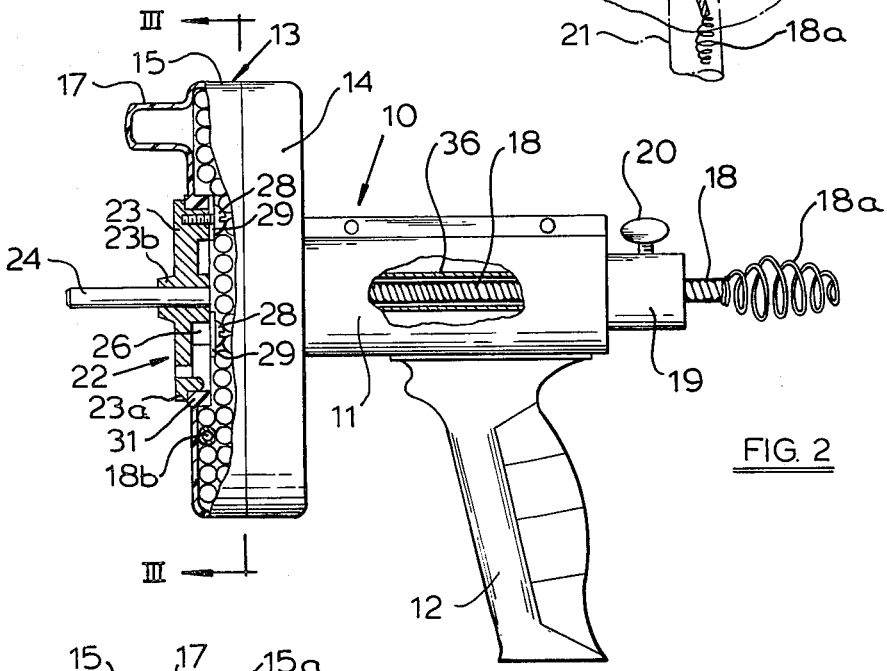
FIG. 2 is a side view, partly broken away, of a drain cleaning tool with the drive attachment disclosed herein attached thereto.

A drain, pipe and trap cleaning tool marketed under the trademark "BLOCKAGE BUSTER" is shown in perspective in FIG. 1 and in side view in FIG. 2 with a drive attachment which is the subject of the present invention attached thereto. The drain cleaning tool is generally referenced at 10 and the drive attachment is generally referenced at 22.

The device 10 has a main body portion 11 from which a pistol-grip handle 12 depends. The main body portion 11 is connected to a rotatable portion 13 by a suitable bearing means (not shown). The rotatable housing 13 consists of two separable halves 14 and 15 which are held together by a number of screws 16 extending through aligned bores in the halves 14 and 15. A handle 17 for facilitating manual rotation of the rotational housing 13 is integrally formed on the half 15.

A conventional plumber's rod, sometimes referred to as a "snake", is coiled within the rotatable housing 13, referenced at **18*b*. The rod 18 terminates in an enlarged end 18*a* which is inserted into a drain 21 to be unclogged. The rod 18 is normally coiled under tension within the housing 13 so that before use of the device a suitable length of rod 18 is pulled from a chuck 19 which is rotatably connected to the main body portion 11, and is held in place outside of the device by a thumb screw 20. The rod 18 may extend through the body portion 11 without a covering, or may be contained in a hollow shaft 36. When the housing 13 is rotated by movement of the handle 17, the rod 18 is rotated, as is the chuck 19, thereby achieving a drilling type motion to loosen debris within the drain 21**.

An attachment for facilitating motorized operation of the device 10 is shown in perspective in FIG. 1 and in cross section in FIG. 2, generally referenced at 22. The attachment consists of a circular disc portion 23 which is received in a correspondingly shaped opening defined by a circular ridge 31 integrally formed at a central rear portion of the housing half 15. The disc 23 has a continuous circumferential flange **23*a* at its edge and is held in place by three bolts 28 which extend through washers 29 into receptacles in the disc 23**.

The disc 23 is further provided with a boss **23*b* which receives and supports a rod 24 which is receivable in a chuck 38 of an electric drill 37, as shown in FIG. 1. When the chuck 38 is tightened about the rod 24, operation of the drill 37 in either a forward or reverse direction will take the place of manual rotation of the handle 17 to rotate the rod 18 within the drain 21. The combination of the drain cleaning tool 10, the drive attachment 22 and the drill 37 can be operated in the manner shown in FIG. 1 with the drain cleaning tool 10 held in a user's left hand 36 and the drill 37 held in the user's right hand 39**.

Figure 3:
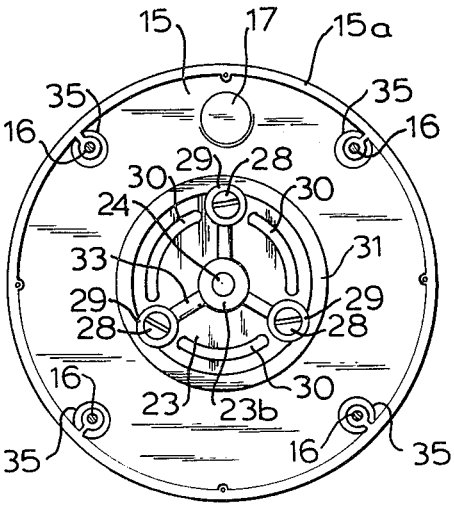
FIG. 3 is a sectional view taken along line III—III of FIG. 2.

Further details of the drive attachment 22 are shown in FIG. 3. The attachment has three annular slots 30 therein which permit air movement for drying of the rod 18 coiled within the housing 13. The attachment 22 is further provided with a boss 26 which is seated beneath each washer 29 in FIG. 3, and can be seen in the side view of FIG. 2. Further, the attachment 22 is provided with three radial ribs 33 extending from the central boss 23*b* to each bolt-receiving boss 26.

As can also be seen from FIG. 3, the halves 14 and 15 are attached by screws 16 received in bores in bosses 35 arranged at the exterior of the half 15. Similar bosses (not shown) are integrally formed on the interior of the half 14. A vertical wall 15*a* defines the periphery of the half 15.

Insertion of the drive attachment 22 is achieved simply by removing the screws 16 holding the halves 14 and 15 together and placing the disc portion 23 of the attachment 22 in the circular opening formed by the ridge 31 in the half 15. The attachment 22 is then fastened in place by tightening the three bolts 28 with the washers 29 associated with each bolt forming a bearing surface in the interior of the housing 13 for maintaining the attachment 22 in place. The halves 14 and 15 are then placed back together and refastened with the screws 16. The chuck 38 of the drill 37 is then attached to the rod 24 and operation in the manner shown in FIG. 1 can take place.

Although modifications and changes may be suggested by those skilled in the art, it is the intention of the inventor to embody within the patent warranted hereon all changes and modifications as reasonably and properly come within the scope of his contribution to the art.

I claim as my invention:

1. A drive attachment for use with a drain cleaning tool and an electric hand-held drill, said tool having a flexible plumber's rod coiled in a rotatable housing and a means for permitting manual feeding of said rod through said tool for insertion and rotation in a drain to be cleaned, said housing having a pre-formed circular opening in a rear face thereof, said drive attachment comprising:

a disc insertable in said circular opening, said disc having an annular flange extending around the circumference thereof, said flange overlapping the edge of said circular opening in said housing for providing a bearing surface for said disc against said housing;

a plurality of bolts received in said disc at a periphery thereof for attaching said disc to said housing, said bolts respectively extending through a plurality of washers which overlap an interior edge of said circular opening for retaining said disc in said opening; and an arbor receivable in a chuck of said drill, said arbor extending perpendicularly from a center of said disc and corotationally affixed thereto, whereby rotational movement is transmitted from said drill to said housing through said drive attachment for rotation of said flexible rod.

2. The drive attachment of claim 1 wherein said disc has a plurality of annular slots therein for circulation of air within said housing.

3. The drive attachment of claim 1 wherein said arbor is received and retained in a central boss integrally formed at a center of said disc.

4. The drive attachment of claim 3 wherein said plurality of bolts are respectively received in a plurality of outer bosses disposed at a periphery of said disc.

5. The drive attachment of claim 4 wherein each of said outer bosses is connected to said central boss by a radial rib integrally formed on said disc.

* * * * *